United States Patent [19]

Gustafson

[11] Patent Number: 4,761,924

[45] Date of Patent: Aug. 9, 1988

[54] SUPPORT MEMBER FOR A BUILDING STRUCTURE SUPPORT SYSTEM

[75] Inventor: Harold L. Gustafson, BattleGround, Wash.

[73] Assignee: Russell Lorenz & Wilma Lorenz, BattleGround, Wash.

[21] Appl. No.: 40,548

[22] Filed: Apr. 17, 1987

[51] Int. Cl.[4] ..... E04C 3/10

[52] U.S. Cl. ..... 52/126.6; 52/126.7; 52/DIG. 11

[58] Field of Search ..... 52/126.6, 126.7, DIG. 11, 52/263; 248/188.4, 354.3

[56] References Cited

U.S. PATENT DOCUMENTS 4,261,149 4/1981 Gustafson ..... 52/292

4,546,581 10/1985 Gustafson ..... 52/262 X

*Primary Examiner*—Carl D. Friedman

*Attorney, Agent, or Firm*—Daniel J. Meaney, Jr.

[57] ABSTRACT

A support member for use in a support system wherein the support member is positioned under a beam of a structure is shown. The support member includes a planar base and a bottom member operatively coupled to the planar base. The bottom member has a vertically extending portion defining a thrust bearing member receiving cavity. A raised locking boss is attached to the planar base and is positioned adjacent the vertically extending portion within the thrust bearing member receiving cavity. A support member which has a planar support plate is passed through the vertically extending portion of the bottom member into mating position with the raised locking boss to lock the same in position and to prohibit rotation thereof about an axis passing perpendicular to the plane of the planar support plate. The support member includes a vertically extending support shaft which is affixed to the planar support plate and includes first coacting surface located around the periphery thereof. A thrust bearing member has a collar and outer lip having an opening extending axially therethrough with the interior thereof formed with a second coacting surface which is capable of coacting with the first coacting surface. An elongated sleeve member, which supports a top member, is in affixed to the collar. The thrust bearing member is brought into contact with the vertically extending support shaft such that said first coacting surface and the second coacting surface coact with each other and are responsive to a rotational force applied therebetween to vary the distance between the planar support plate and the thrust bearing member.

11 Claims, 2 Drawing Sheets

SUPPORT MEMBER FOR A BUILDING STRUCTURE SUPPORT SYSTEM

FIELD OF THE INVENTION

This invention relates to a support member adapted for use in a building structure support system and more particularly relates to a support member having a thrust bearing member affixed to a sleeve wherein the thrust bearing member coacts with a support member having a planar support plate supporting a vertically extending support shaft which is inserted into a vertically extending portion of a bottom member and into mating engagement with a raised locking boss which prohibits rotation of the planar support plate as the thrust bearing member-elongated sleeve member subassembly is rotated about its longitudinal axis to vary the height between the planar support plate and the thrust bearing member which adjusts the distance between the planar base and the top member which engages and supports a beam.

DESCRIPTION OF THE PRIOR ART

It is known in the art to provide a support system for a building such as a mobile home, manufactured home, permanent building structure or the like. Two such support systems are disclosed in U.S. Pat. Nos. 4,261,149 and 4,546,581, both of which are inventions of the same inventor of the present invention.

In U.S. Pat. No. 4,546,581, the support member has a planar base with a vertically extending, threaded support member extending therefrom which coacts with a threaded inner surface of an elongated thrust member. The outer rim of the elongated thrust member has protruding tabs which cooperate with slots formed in the outer rim of a sleeve to adjust height of the support member. The vertically extending, threaded support member must be affixed so as to extend almost exactly perpendicular from the planar base in order to smoothly engage and coact with the elongated thrust member.

SUMMARY OF THE PRESENT INVENTION

The present invention discloses an improved novel and unique support member. In the present invention, the support member is adapted for use in a support system for a building structure having a foundation formed of a plurality of spaced, parallel support beams. The support member is adapted to be positioned under one of the beams. The support member includes a planar base having a preselected cross-sectional area and a bottom member operatively coupled to the planar base. The planar base has a vertically extending portion thereof formed of a selected internal geometrical dimension and which defines a hollowed-out thrust bearing member receiving cavity. The bottom member includes at least one pair of aligned base tabs positioned adjacent the planar base and one on each side of the vertically extending portion positioned adjacent the planar base. A raised locking boss is attached to the planar base and is positioned adjacent the vertically extending portion within the hollowed-out thrust bearing member receiving cavity. A support member includes a planar support plate which has a geometrical dimension and shape to pass through the hollowed-out thrust bearing member receiving cavity defined by the vertically extending portion of the bottom member and into mating position with that portion of the planar base enclosed by the hollowed-out thrust bearing member defining cavity. The raised locking boss coacts with the planar support plate to lock the same in position and to prohibit rotation thereof about an axis passing perpendicular to the plane of said planar support plate. The support member also includes a vertically extending support shaft of a selected length and predetermined external dimension and shape. The vertically extending support shaft is affixed to the planar support plate and includes a first coacting means located around the periphery thereof. A thrust bearing member, having a selected axial length, includes means defining an outer lip at one end thereof having a selected external geometrical dimension and with an inner collar extending therefrom having a selected external dimension which is less than the selected external dimension. The thrust bearing member including means for defining an opening which extends axially therethrough and means for forming an interior wall having a second coacting means located thereon which is capable of coacting with said first coacting means in response to a rotational force applied around the longitudinal axis thereof to produce relative movement therebetween. The opening in the thrust bearing member has a cross-sectional diameter and shape which is adapted to receive and pass the vertically extending support shaft. An elongated sleeve member has an elongated central opening extending therethrough and rims formed at each end thereof with the internal dimensions thereof being substantially equal to the selected external dimensions of the collar of the thrust bearing member to enable the collar to be inserted into said elongated sleeve member until the end or rim of the elongated sleeve member is contiguous to and affixed to the outer lip of said collar. The elongated sleeve member has an external geometrical dimension which is of a shape and dimension to permit one end of the elongated sleeve member, having the thrust bearing member affixed thereto, to be inserted into and transported within the hollowed-out thrust bearing member cavity in the vertically extending portion of the bottom member until said thrust bearing member opening is brought into contact with the vertically extending support shaft such that the first coacting means and said second coacting means coact with each other and are responsive to a rotational force applied therebetween to vary the distance between the planar support plate, locked in position by the raised locking boss to prevent rotation thereof, and the thrust bearing member. A top member has a top stabilizing plate and an extended lower portion formed of an internal geometrical dimension and shape which is adapted to receive and slide over the other end of the elongated sleeve member permitting the other end to slide within the extended lower portion of the top member into engagement with a top stabilizing plate. The top member includes gripping means which are adapted to be fixedly attached to the stabilizing plate and to one of the beams. The top stabilizing plate has at least one pair of aligned top tabs positioned one on each side of the lower extended portion of the top member and positioned in spaced parallel alignment with the at least one pair of base tabs. At least two strut stabilizing rods are used wherein each stabilizing rod has one end thereof extending from at least one of a selected one of the top tabs and a selected one of the bottom tabs. A means for fixedly connecting the one of the strut stabilizing rods to at least one of said selected tabs and a selected bottom tab is provided.

The prior art support system as disclosed in U.S. Pat. No. 4,546,581 requires, during assembly thereof, that the vertically extending support member is truly perpendicular to the planar base such that when the elongated thrust member is positioned thereon that the interior thereof engages and coacts with the vertically extending support member without binding and/or without the threads thereof being cocked or otherwise out of alignment making adjustment of the elongated thrust member relative to the vertically extending support member difficult. If the alignment of the vertically extending support member is off relative to the planar base, that is the vertically extending support member is not exactly perpendicular to the planar base, difficulties may be encountered during the installation, assembly and/or adjustment of the support member resulting in the first coacting means being unable to coact with second means due to binding of the threads and the like.

One advantage of the present invention is that the vertically extending support shaft is affixed to a planar support plate, which in turn, is passed through a hollowed-out thrust bearing member receiving cavity formed in the vertically extending portion of a bottom member. The base member is attached to a planar base. The interior of the hollowed-out thrust bearing member receiving member cavity includes a raised locking boss, which is attached to the planar base, which engages and holds the planar support plate to prevent rotation thereof. As a result, if the vertically extending support shaft is slightly out of alignment relative to the planar base, the planar support plate will move relative to the planar base to eliminate any binding of the threads and the like. The planar support plate moving relative to the planar base compensates for any such differences while permitting the first coacting means located around the periphery of the vertically extending support shaft to coact with a second coacting means, located interiorly of a thrust bearing member, without binding.

Another advantage of the present invention is that the support member can have the thrust bearing member compression fixed to the end of the elongated sleeve member to form a subassembly.

Another advantage of the present invention is that assembly and installation of the support member at a work site is easily accomplished by inserting the thrust bearing member-elongated sleeve member subassembly into the thrust bearing member receiving cavity of the bottom member engaging the first coacting means and the second coacting means such that rotation of the subassembly relative to the vertically extending support shaft quickly enables the adjustment of the support member to the desired distance between the planar base and a top member supporting the load.

BRIEF DESCRIPTION OF THE DRAWINGS

These and other advantages of the present invention will become apparent when considered in light of the detailed description hereinafter of the preferred embodiment, which includes the following figures.

DESCRIPTION OF THE PREFERRED EMBODIMENT

Figure 1:
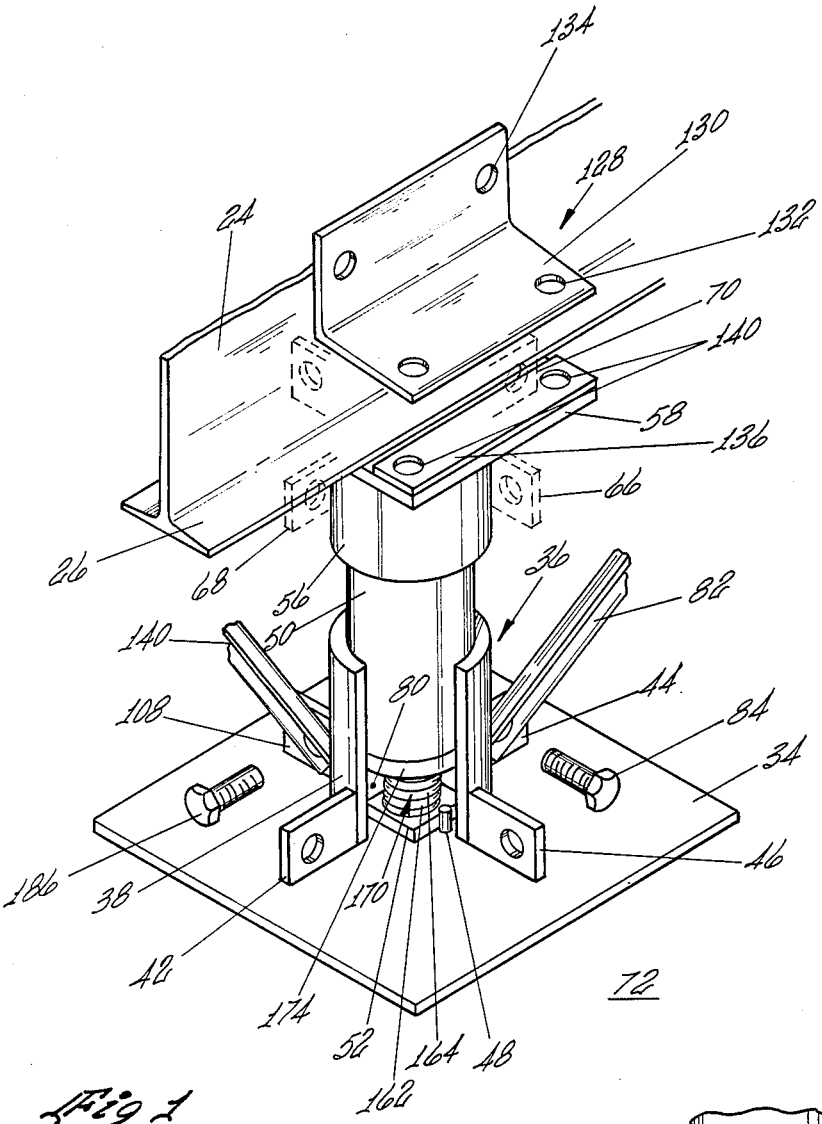
FIG. 1 is a perspective view in a partial cut-away illustrating a support member and gripping means of the present invention.

FIG. 1 illustrates that the support member of the present invention is adapted for use in a support system for a building structure having a foundation. In the preferred embodiment, the building structure has a foundation formed of a plurality of spaced parallel support beams 24, wherein the support member, shown generally as 20, is adapted to be positioned under one of the beams 24, which beam is illustrated to be an "I" beam having a lower flange 26 and an upper flange 28. The "I" beam 24 is adapted to have the upper flange 28 in engagement with and/or secured to the foundation of a building structure.

Figure 3:
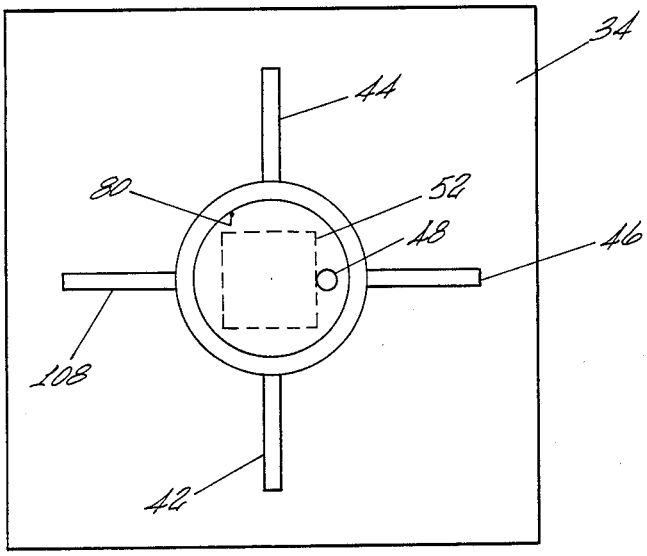
FIG. 3 is a top plan view of the planar base having the bottom member affixed thereto showing the thrust bearing member receiving cavity having the raised locking boss with the planar support plate which supports the vertically extending loading support, in phantom, positioned against the raised locking boss to prevent rotation of the planar support plate within the thrust bearing member receiving cavity.

The support member 20 includes a planar base 34 having a preselected cross-sectional area. A bottom member 36 has a vertically extending portion 38 which coupled to or fixedly attached to the planar base 34. The bottom member 36 is typically welded to the planar base 34. The bottom member 36 has a vertically extending portion 38 formed of a selected internal geometrical dimension and which defines a hollowed-out thrust bearing member receiving cavity 80 which is also shown in FIG. 3. The bottom member 36 including at least one pair of aligned base tabs 42 and 44 positioned adjacent the planar base 34 and one on each side of the vertically extending portion 38. The other pair of aligned base tabs 46 and 108 are likewise so positioned on the vertically extending portion 38 such that tabs 42, 44, 46 and 108 are spaced equidistantly therearound.

A raised locking boss 48 is attached to the planar base 34 and is positioned adjacent the vertically extending portion 38 within the hollowed-out thrust bearing member receiving cavity 80.

A support member assembly includes the planar support plate 52 having a geometrical dimension and shape to pass through the hollowed-out thrust bearing member receiving cavity 80 defined by the vertically extending portion 38 of the bottom member 36 and into mating position with that portion of the planar base 34 enclosed by the hollowed-out thrust bearing member defining cavity 80. The raised locking boss 48 coacts with the planar support plate 52 to lock the same in position and to prohibit rotation thereof about an axis passing perpendicular to the plane of the planar support plate 52.

The support member 20 also includes a vertically extending support shaft, shown as element 162, of a selected length and predetermined external dimension and shape. The vertically extending support shaft 162 is affixed to the planar support plate 52 such as by welding the vertically extending support shaft substantially perpendicular the planar support plate 52. The vertically extending support shaft 162 includes first coacting means 164 located around the periphery thereof as is shown in greater detail in FIG. 2.

A thrust bearing member 170, which functions to support the vertically loading, has a selected axial length and means defining an outer lip 174 at one end thereof. The outer lip 174 has a selected external geometrical dimension which mates with an inner collar 178 extending therefrom. The inner coller 178 has a selected external dimension which is less than the selected external dimension of the outer lip 174, and is of a dimension to receive and support the end or rim of the elongated sleeve member 50. The inner walls of the thrust bearing member 170 includes means for defining an opening 182 having a cross-sectional diameter and shape which is adapted to receive and pass the vertically extending support member 162.

Figure 4:
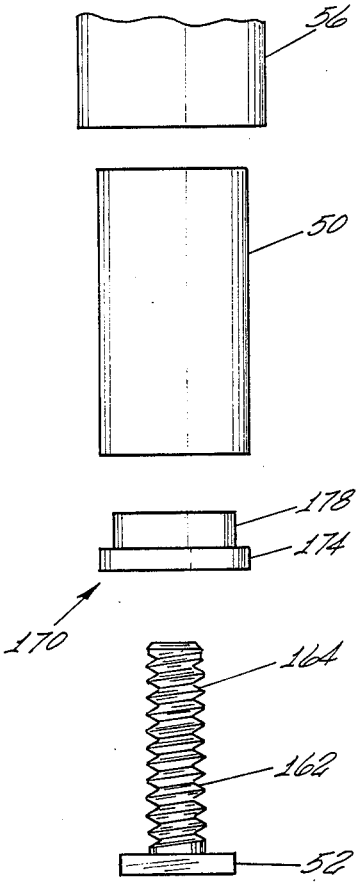
FIG. 4 is an exploded view showing the relationship between the vertically extended support shaft affixed to the planar support plate, the thrust bearing member having an inner coller and an outer lip and the end of the elongated sleeve member which is attached to the inner coller of the thrust bearing member by a compression fit.
Figure 5:
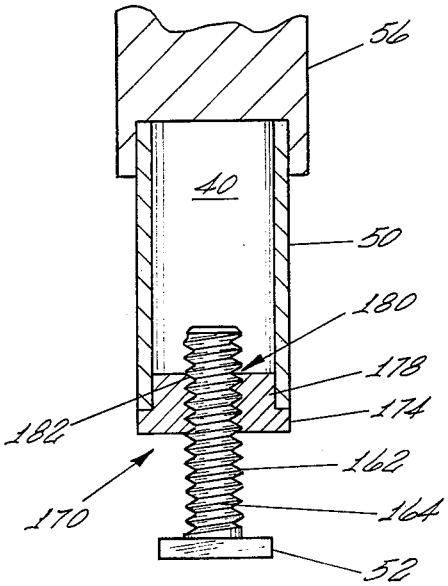
FIG. 5 is a partial front plan view partially in cross-section showing the elements of FIG. 4 as the same are assembled interiorly within the support member.

The thrust bearing member 170 includes means for defining a opening 180, shown in FIG. 5, which extends axially therethrough and means for forming an interior wall in the center thereof. The opening 180 has a cross-sectional diameter and shape which is adapted to receive and pass the vertically extending support shaft 162. The means for forming the inner walls also define a second coacting means 182 located thereon which is capable of coacting with the first coacting means 164. This is discussed in greater detail in connection with FIGS. 2 and 4.

The elongated sleeve member 50 has an elongated central opening 40 extending therethrough forming rims at each end thereof. The elongated sleeve member 50 is adapted to be located between the bottom member 36 and top member 54. The details of the structural arrangement between the elongated sleeve member 50, the thrust bearing member 170, the construction of the vertically extending support shaft 162 and the planar support plate 52 are illustrated in greater detail in FIGS. 2 and 4.

The top member, illustrated generally as element 54, has an extended lower portion 56 and a top stabilizing plate 58. The extended lower portion 56 of top member 54 is formed of an internal geometrical dimension and shape to receive and slide over the other end of the elongated sleeve member 50. This permits the other end of elongated sleeve member 50 to slide within the extended lower portion 58 of the top member 54 into engagement with the top stabilizing plate 58. The top member 54 includes gripping means, shown generally as 128, which is adapted to be fixedly attached to the stabilizing plate 58 and to the "I" beam 24. The top stabilizing plate 58 has at least one pair of aligned top tabs 68 and 70 as illustrated in FIG. 1. The aligned top tabs 68 and 70 are positioned one on each side of the extended lower portion 56 of the top member 54 and postioned in spaced parallel alignment with the at least one pair of base tabs 42 and 44 located directly therebelow on the vertically extending portion 38 of bottom member 36.

In use, the distance between the top stabilizing plate 58 and the planar base 34 is adjustable to control the height therebetween to position or adjust foundation 30 to a predetermined distance from and "I" beam 24 essentially parallel to the ground 72. If desired, a concrete footing may be placed under the planar base 34.

In the embodiment illustrated in FIG. 1, the internal support system includes a strut stabilizing rod 82 which has one end extending from one of the selected bottom tabs. For example, one end of strut stabilizing rod 82 is operatively coupled by a fastener 84 to the aligned base tab 44. It is necessary to have at least two strut stabilizing rods attached to a support member to provide the desired rigidity and stability.

Strut stabilizing rod 82 illustrated in FIG. 1 has its other end operatively coupled to a strut stabilizing rod gripping means (not shown) which is similar in structure and construction to the gripping means 128 for fixedly connected the same to the "I" beam 24. In this arrangement, at least two strut stabilizing rods each having one end extending from at least one of a selected one of the top tabs and a selected one of the bottom tabs.

Fastening means, such as for example a stress bolt 186, are used for fixedly connecting said one of said strut stabilizing rods, for example strut stabilizing rod 140, to at least one of said selected tabs and a selected bottom tab, e.g. bottom tab 108.

In FIG. 1, the support member 20 is adapted to be permanently coupled to an "I" beam 24 having a lower flange 26. The gripping means 128 includes a support gripper plate 130 which is adapted to supportably engage one of the support beams, such as lower flange 26 of the "I" beam 24. The other edge of support gripper plate 130 is adapted to be in contact with a support gripper spacer 136. As illustrated in FIG. 1, the support gripper plate 130 can be formed into an "L" shaped or angle iron arrangement. In the alternative, the support gripper plate could be a flat plate utilizing the bottom portion only of the support gripper plate 130. The lower portion of the support gripper plate 130 has two apertures 132 which are adapted to permit the passage of fasteners therethrough in order to develop a clamping force between the support gripper plate 130 and the support gripper spacer 136. The support gripper spacer 136 cooperates with the top stabilizing plate 58 to develop a clamping force which brings the edge of the support gripper plate 130 into tight frictional engagement with the support beam 24.

In the alternative, if desired, the upper portion of the support gripper plate 130 could have a plurality of apertures, shown as apertures 134, which permit connecting the support gripper plate 130 directly to the beam. Thus, the fasteners would be passed through aperture 132 of the support gripper plate 130 through the support gripper spacer 136 which is adapted to engage the surface of the support gripper plate 130 adjacent the support beam 24, and through apertures formed in the top stabilizing plate 58.

In applications where it is undesireable to form apertures in the "I" beam, or where apertures are not required, apertures 134 in support gripper plate 130 can be omitted.

Figure 2:
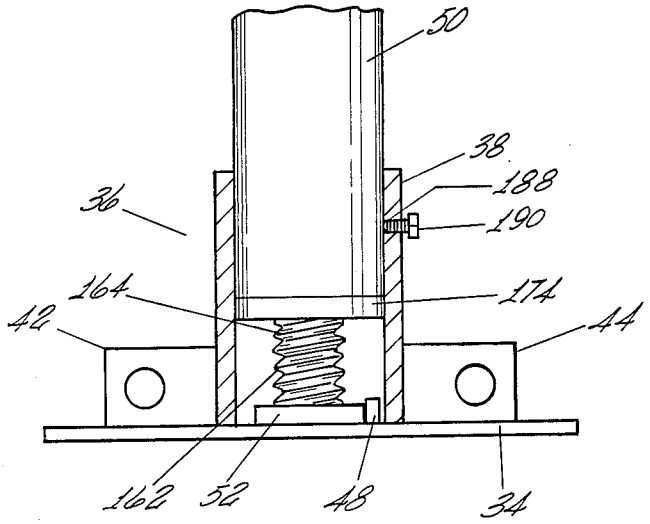
FIG. 2 is a partial, cross-sectional view illustrating the relationship between the various components which provide the adjusting capability of controlling the axial distance between a top member and the planar base of a support structure.

FIG. 2 illustrates the planar support plate 52 having the vertically extending support shaft 162 extending therefrom. The first coacting means 164, e.g. threads, are adapted to coact with the second coacting means 182, e.g. a threaded bore, within the interior of the thrust bearing member 170. The thrust bearing member 170 has its outer lip 174 positioned near the vertically extending support shaft 162. The inner collar 178 has a smaller dimension than that of the outer lip 174, and is adapted to have the end of the elongated sleeve member 50 passed onto the collar. The elongated sleeve member 50 is then affixed to the coller, e.g. by a compression fit or welded joint.

As illustrated in FIG. 2, in order to securely hold the external sleeve member 50 in position after the same is adjusted to a desired height, an opening 188 is formed in the vertically extending portion 38 of the bottom member 36 to permit an external fastener 190 to be threaded therethrough to lock the thrust bearing member 170-elongated sleeve member 50 subassembly in position and to prevent rotation thereof relative to the vertically extending support shaft 162.

In the top plan view of FIG. 3, the planar base 34 has the bottom member 36 affixed which forms the hollowed-out thrust bearing member receiving cavity 40 having the raised locking boss 48. The raised locking boss 48 is shown in the locking position against the planar support plate 52, shown in phantom for clarity, to prevent rotation of the planar support plate 52 within the hollowed-out thrust bearing member defining cavity 80. The planar support plate 52, in turn, supports the vertically extending support shaft 162 as illustrated in FIG. 4 and 5 to permit relative rotation of the thrust bearing member 170 and elongated sleeve member 50 subassembly relative to the vertically extending support shaft affixed to the planar support plate 52.

In the exploded view of FIG. 4 the assembly of the vertically extending support shaft 162 is illustrated to show the position of the same in coacting relationship with the thrust bearing member 170. The planar support plate 52 can move relative to the planar base 34. However, the planar support plate 52 locked in position by the raised locking boss 48 to prevent rotation thereof around an axis that is essentially planar to the planar support plate 52. The thrust bearing member 170 and the elongated sleeve member 50 are shown prior to assembly and joining of the same.

In the partial front plan view of FIG. 5, the vertically extended support shaft 162 is shown affixed to the planar support plate 52. The thrust bearing member 170, which has the outer lip 174 and the inner coller 178, is shown with the end of the elongated sleeve member 50 attached, by a compression fit, to the inner coller 178 of the thrust bearing member 170. The threads 164 on the periphery of the vertically extending support shaft 162 are threaded into the opening 180 having threads 182 in the interior of the thrust bearing member 170.

As shown in FIG. 5, the internal dimensions of the elongated sleeve member 50 is substantially equal to the selected external dimensions of the collar 178 of the thrust bearing member 170 to enable the collar 178 to be inserted into the elongated sleeve member 50 until the end thereof is contiguous to the outer lip 174 of the collar 170. The elongated sleeve member 50 has an external geometrical dimension which is of a shape and dimension to permit one end of the elongated sleeve member 50 having the thrust bearing member 170 affixed thereto to be inserted into and transported within the hollowed-out thrust bearing member receiving cavity 80 in the bottom member 36 until the threaded opening 180 of the thrust bearing member 170 is brought into contact with the vertically extending support shaft 162 such that the first coacting means 164 and the second coacting means 174 coact with each other and are responsive to a rotational force applied therebetween to vary the distance between the planar support plate 52, locked in position by the raised locking boss 48 to prevent rotation thereof, and the thrust bearing member 170.

Thus, when a rotational force is applied around the longitudinal axis of the vertically extending support shaft 162, the thrust bearing member 170 and the elongated sleeve member 50 affixed to the inner coller 178 of the thrust bearing member 170, relative movement is produced therebetween to obtain the desired adjustment of height ultimately desired between the planar base 32 and the top member 54.

In the preferred embodiment, the planar support plate 52 is rectangular in shape and the raised locking boss 48 is a weld spot which has a sufficient height to engage and hold the rectangular planar support plate 52.

The gripping means 128 comprises a U-shaped member adapted to receive and support a beam. The gripping means 128, as well the strut stabilizing rod gripping means affixed to the beam having substantially the same structure as the gripping means 128, is capable of producing an initial tight frictional clamping force between one edge of the support gripper plate 130 and a the lower flange 26 on one side of a support "I" beam 24 in the order of at least 16,000 pounds and a continuing frictional clamping force in the order of at least 300 foot pounds.

The support member, when used as at least one vertical support, is capable of withstanding a vertical load of about 120,000 pounds and an ultimate load of about 136,000 pounds.

In installing a support system using the support member of the present invention under a building structure, each individual support member can have its height adjusted to an appropriate level such that the foundation is relatively level in a horizontal direction and the top stabilizing plates of each support member lie essentially in a coplanar relationship with each other. Thus, prior to such a unit experiencing any seismic activity, the foundation is supported at the corners and center thereof and substantially in a coplanar relationship with a plurality of support points. After such a foundation experiences a seismic wave, it is relatively easy to readjust the heights of the support members 20 to bring the foundation back into a substantial horizontal relationship, if any such change is experienced during the seismic wave, such that all support points are still subject to support.

What is claimed is:

1. A support member adapted for use in a support system for a building structure having a foundation formed of a plurality of spaced, parallel support beams wherein said support member is adapted to be positioned under one of a said beam, said support member comprising a planar base having a preselected cross-sectional area;

a bottom member operatively coupled to said planar base and having a vertically extending portion formed of a selected internal geometrical dimension and which defines a hollowed-out thrust bearing member receiving cavity, said bottom member including at least one pair of aligned base tabs positioned adjacent the planar base and one on each side of the vertically extending portion positioned adjacent the planar base;

a raised locking boss attached to said planar base and being positioned adjacent said vertically extending portion within the hollowed-out thrust bearing member receiving cavity;

a support member including a planar support plate having a geometrical dimension and shape to pass through the vertically extending portion of said bottom member and into mating position with that portion of the planar base enclosed by said hollowed out thrust bearing member member receiving cavity wherein the raised locking boss coacts with said planar support plate to lock the same in position and to prohibit rotation thereof about an axis passing perpendicular to the plane of said planar support plate, said support member including a vertically extending support shaft of a selected length and predetermined external dimension and shape, said vertically extending support shaft being affixed to said planar support plate and including first coacting means located around the periphery thereof;

a thrust bearing member having a selected axial length and means defining an outer lip at one end thereof having a selected external geometrical dimension with an inner collar extending therefrom having a selected external dimension which is less than said selected external dimension, said thrust bearing member including interior wall means for defining an opening which extends axially therethrough and means for forming an interior wall having a second coacting means located thereon which is capable of coacting with said first coacting means in response to a rotational force applied around the longitudinal axis thereof to produce relative movement therebetween, said opening in said thrust bearing member having a cross-sectional diameter and shape which is adapted to receive and pass vertically extending support shaft;

an elongated sleeve member having an elongated central opening extending therethrough forming rims at each end thereof with the internal dimensions thereof being substantially equal to the selected external dimensions of the collar of said thrust bearing member to enable the collar to be inserted into said elongated sleeve until the rim of the sleeve is contiguous to the outer edge of said collar, said elongated sleeve member having an external geometrical dimension thereof which is of a shape and dimension to permit said one end of the elongated sleeve member having said thrust bearing member affixed thereto to be inserted into and transported within the hollowed-out thrust bearing member receiving cavity in said bottom member until said opening in said thrust bearing member is brought into contact with said vertically extending support shaft such that said first coacting means and said second coacting means coact with each other and are responsive to a rotational force applied therebetween to vary the distance between the planar support plate, locked in position by said locking boss to prevent rotation thereof, and said thrust bearing;

a top member having a top stabilizing plate and an extended lower portion formed of an internal geometrical dimension and shape to receive and slide over the other end of said elongated sleeve member permitting the other end thereof to slide within said extended lower portion of said top member into engagement with said top stabilizing plate, said top member including gripping means adapted to be fixedly attached to said stabilizing plate and to one of said beams, said top stabilizing plate plate having at least one pair of aligned top tabs positioned one on each side of the lower extended portion of the top member and positioned in spaced parallel alignment with said at least one pair of base tabs;

at least two strut stabilizing rods each having one end extending from a selected one of the bottom tabs; and means for fixedly connecting said one end of each of said strut stabilizing rods to a selected one of the bottom tabs.

2. The support member of claim 1 wherein said first and second coacting means are threaded members.

3. The support member of claim 1 wherein said thrust bearing member is attached to the one end of said elongated sleeve member by a compression fitting.

4. The support member of claim 3 wherein said planar support plate is rectangular in shape and wherein the raised locking boss is a weld spot which has a sufficient height and to engage and hold the rectangular planar support plate to prevent rotation therof about an axis perpendicualr to the plane of said planar support plate.

5. The support member of claim 1 wherein said gripping means includes an L-shaped member adapted to receive and support a beam.

6. The support member of claim 1 wherein said gripping means is capable of producing an initial tight frictional clamping force between said one edge of the strut stabilizing gripper plate and a the bottom flange on one side of a support beam in the order of at least 16,000 pounds and a continuing frictional clamping force in the order of at lease 300 foot pounds.

7. The support member of claim 1 wherein said at least one vertical support is capable of withstanding a vertical load of about 120,000 pounds and an ultimate load of about 136,000 pounds.

8. A support member adapted to be positioned under and support a beam, said support member comprising a planar base;

a bottom member operatively coupled to said planar base and having a vertically extending portion which defines a hollowed-out thrust bearing member receiving cavity;

a raised locking boss attached to said planar base and being positioned adjacent said vertically extending portion within the hollowed-out thrust bearing member receiving cavity;

a support member including a planar support plate having a geometrical dimension and shape to pass through the vertically extending portion of said bottom member and into mating position with that portion of the planar base enclosed by said hollowed-out thrust bearing member receiving cavity wherein the raised locking boss coacts with said planar support plate to lock the same in position and to prohibit rotation thereof about an axis passing perpendicular to the plane of said planar thrust plate, said support member including a vertically extending support shaft of a selected length and predetemined external dimension and shape, said vertically extending support shaft being affixed to said planar support plate and including first coacting means located around the periphery thereof;

a thrust bearing member having a selected axial length and means defining an outer surface having a selected external dimension which is less than said selected external dimension, said thrust bearing member including means for an opening which extends axially therethrough and means for forming an interior wall having a second coacting means located thereon which is capable of coacting with said first coacting means in response to a rotational force applied around the longitudinal axis thereof to produce relative movement therebetween, said opening having a cross-sectional diameter and shape which is adapted to receive and pass said vertically extending support member;

an elongated sleeve member with an internal dimension thereof substantially equal to the selected external dimensions of the outer surface of said collar of said thrust bearing member to enable the collar to be inserted into and affixed to said elongated sleeve member, said elongated sleeve member having an external geometrical dimension thereof which is of a shape and dimension to permit said one end of the elongated sleeve member having said thrust bearing member affixed thereto to be inserted into and transported within the hollowed-out thrust receiving cavity in said bottom member until said the opening in said thrust bearing member is brought into contact with said vertically extending support shaft such that said first coacting means and said second coacting means coact with each other and are responsive to a rotational force applied therebetween to vary the distance between the planar support plate, locked in position by said locking boss to prevent rotation thereof, and said thrust bearing member.

9. The support member of claim 8 further comprising a top member having a top stabilizing plate and an extended lower portion formed of an internal geometrical dimension and shape to receive and slide over the other end of said elongated sleeve member permitting the outed to slide within said extended lower portion of said top member into engagement with said top stabilizing plate.

10. The support member of claim 9 wherein said top member includes gripping means adapted to be fixedly attached to said stabilizing plate and to one of said beams and wherein said top stabilizing plate plate has at least one pair of aligned top tabs positioned one on each side of the lower extended portion of the top member and postioned in spaced parallel alignment with said at least one pair of base tabs.

11. The support member of claim 10 including at least two strut stabilizing rods each having one end extending from a selected one of the bottom tabs; and means for fixedly connecting said one end of each of said strut stabilizing rods to a selected one of the bottom tabs.

* * * * *